US008769795B2

(12) United States Patent
Kash et al.

(10) Patent No.: US 8,769,795 B2
(45) Date of Patent: Jul. 8, 2014

(54) METHOD FOR MAKING A RUST RESISTANT WELL PERFORATING GUN WITH GRIPPING SURFACES

(76) Inventors: Edward Cannoy Kash, Houston, TX (US); James Edward Kash, Houston, TX (US)

( * ) Notice: Subject to any disclaimer, the term of this patent is extended or adjusted under 35 U.S.C. 154(b) by 415 days.

(21) Appl. No.: 13/276,038

(22) Filed: Oct. 18, 2011

(65) Prior Publication Data

US 2013/0036898 A1 Feb. 14, 2013

Related U.S. Application Data

(60) Provisional application No. 61/522,509, filed on Aug. 11, 2011, provisional application No. 61/522,512, filed on Aug. 11, 2011.

(51) Int. Cl.
*B23P 25/00* (2006.01)
*E21B 43/119* (2006.01)
*E21B 43/116* (2006.01)

(52) U.S. Cl.
CPC ..... *E21B 43/116* (2013.01); *E21B 43/119* (2013.01)
USPC ..... 29/458; 89/1.151

(58) Field of Classification Search
CPC .... B21D 39/04; B21D 26/033; B21D 39/203; F16B 33/06; B23P 11/00; B23P 19/04; B23P 19/02; E21B 43/119; E21B 43/11; E21B 43/116; E21B 31/002; E21B 43/112; B21B 29/02
USPC ..... 29/458, 422.1, 412.1, 434, 453, 455.1, 29/469, 506, 525.01, 525.14; 89/1.151; 166/297, 298, 55, 55.1
See application file for complete search history.

(56) References Cited

U.S. PATENT DOCUMENTS

| | | | | |
|---|---|---|---|---|
| 2,649,046 | A | 5/1947 | Davis | |
| 2,750,885 | A | 11/1949 | Schlumberger | |
| 2,980,017 | A | 7/1953 | Castel | |
| 4,523,649 | A | 6/1985 | Stout | |
| 4,534,423 | A * | 8/1985 | Regalbuto | 175/4.6 |
| 4,850,438 | A | 7/1989 | Regalbuto | |
| 4,889,183 | A | 12/1989 | Sommers et al. | |
| 4,919,050 | A | 4/1990 | Dobrinski et al. | |
| 5,095,999 | A | 3/1992 | Markel | |
| 5,775,426 | A | 7/1998 | Snider et al. | |
| 5,960,894 | A | 10/1999 | Lilly et al. | |
| 6,012,525 | A * | 1/2000 | Burleson et al. | 166/297 |
| 6,336,506 | B2 | 1/2002 | Wesson | |
| 6,347,673 | B1 | 2/2002 | Dailey | |
| 6,520,258 | B1 | 2/2003 | Yang et al. | |
| 6,554,081 | B1 | 4/2003 | Brooks et al. | |
| 6,679,327 | B2 | 1/2004 | Sloan et al. | |
| 6,732,798 | B2 | 5/2004 | Johnson et al. | |

(Continued)

*Primary Examiner* — John C Hong
(74) *Attorney, Agent, or Firm* — Buskop Law Group, PC; Wendy Buskop

(57) ABSTRACT

A method for perforating a well using a rust resistant well perforating gun can include disposing coatings over the rust resistant well perforating gun to prevent rust, loading a charge into a charge hole, engaging a detonation cord with the charge and an actuator, engaging the charge loading tube into the gun carrier, lowering the rust resistant well perforating gun into the well, actuating the actuator, and exploding the charge to: form a high pressure in the gap, allow jets to pierce the recesses to produce high energy pulses, and fractionate the formation using the high energy pulses.

20 Claims, 8 Drawing Sheets

(56) References Cited

U.S. PATENT DOCUMENTS

| | | | | |
|---|---|---|---|---|
| 6,865,792 | B2 | 3/2005 | Kash | |
| 6,865,978 | B2 | 3/2005 | Kash | |
| 6,926,096 | B2 | 8/2005 | Kash | |
| 7,055,421 | B2 | 6/2006 | Kash | |
| 7,246,548 | B2 | 7/2007 | Kash | |
| 2002/0134585 | A1 | 9/2002 | Walker | |
| 2010/0089643 | A1 * | 4/2010 | Vidal | 175/2 |

* cited by examiner

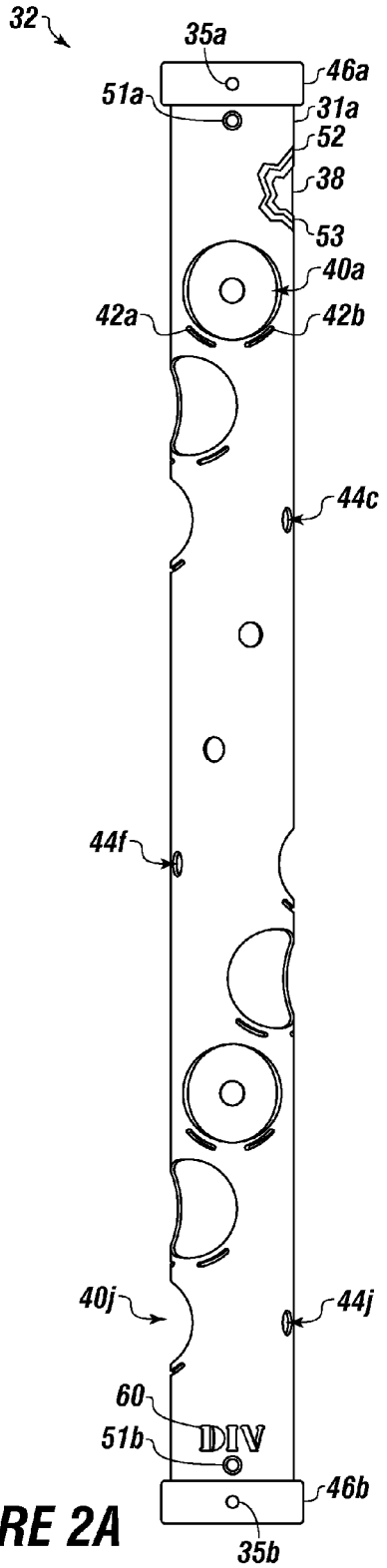
FIGURE 2A
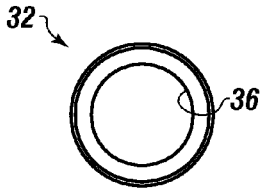
FIGURE 2B
FIGURE 2C
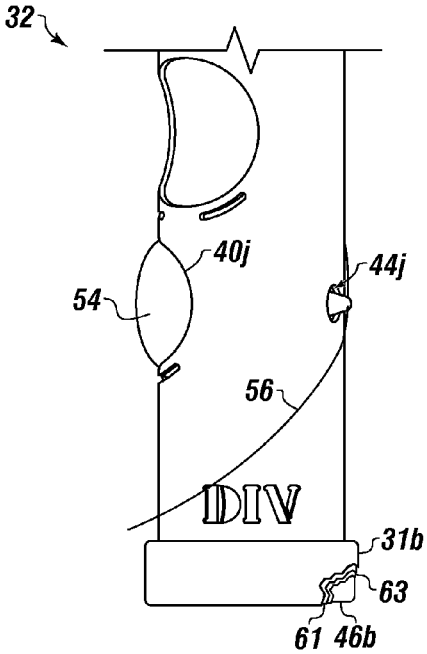

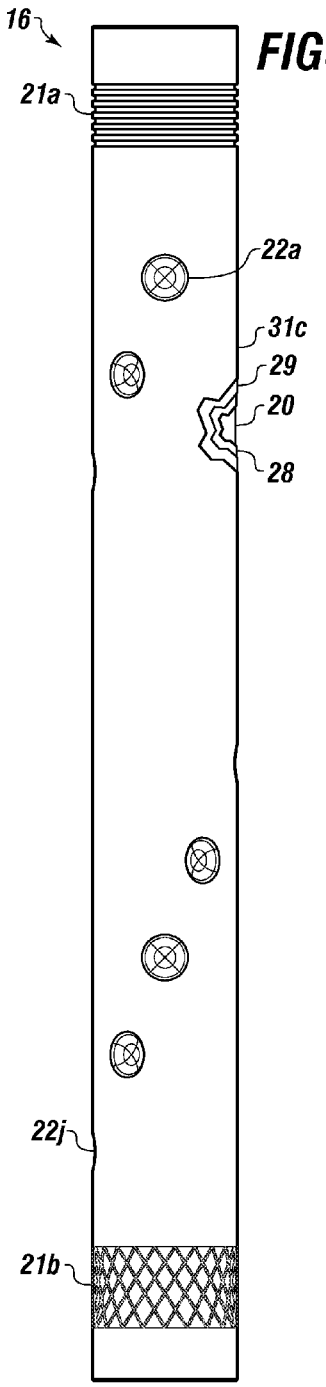
FIGURE 3A
FIGURE 3B
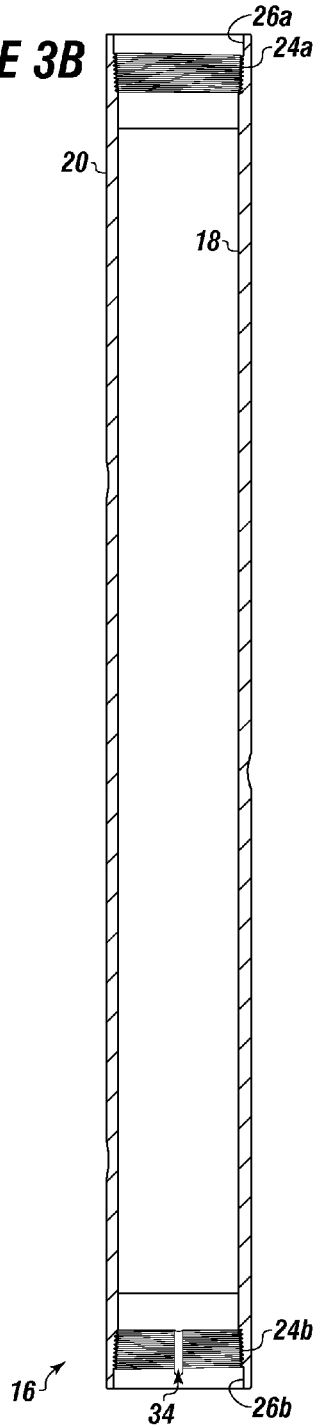

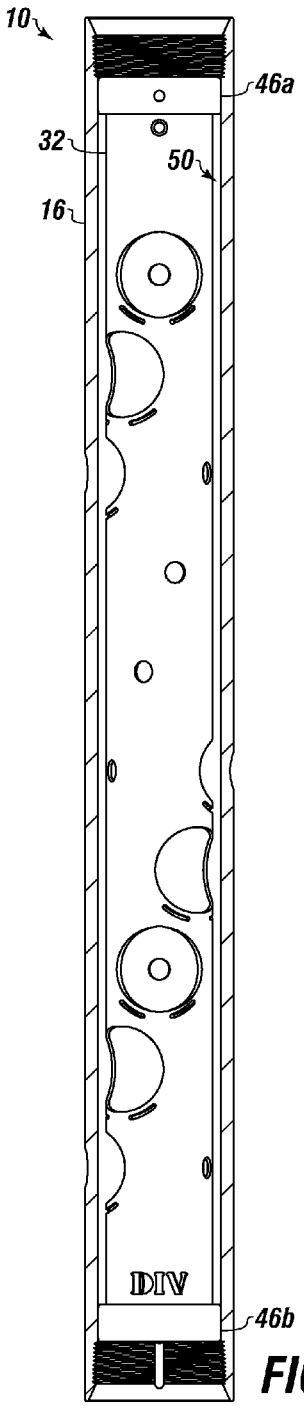
FIGURE 4A
FIGURE 4B
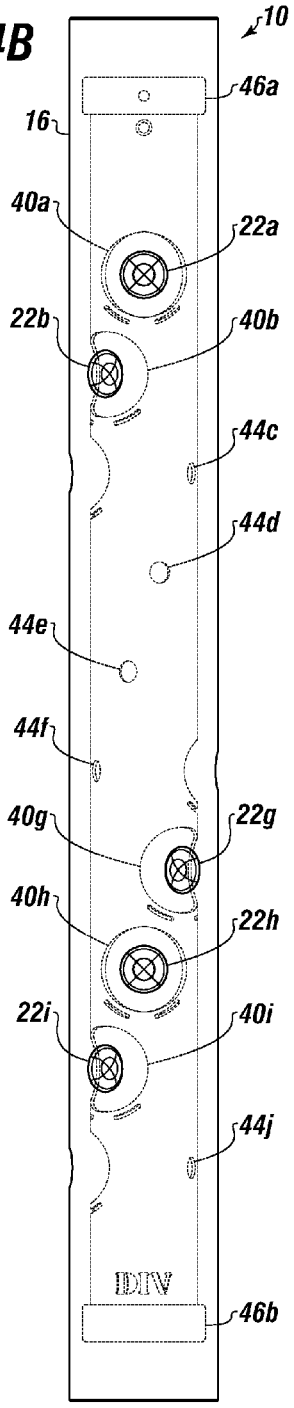

METHOD FOR MAKING A RUST RESISTANT WELL PERFORATING GUN WITH GRIPPING SURFACES

CROSS REFERENCE TO RELATED APPLICATION

The present application is a non-provisional of and claims priority to and the benefit of U.S. Provisional Patent Application No. 61/522,509 filed on Aug. 11, 2011, entitled "RUST RESISTANT WELL PERFORATING GUN", and U.S. Provisional Patent Application No. 61/522,512 filed on Aug. 11, 2011, entitled "METHOD FOR PERFORATING A WELL USING A RUST RESISTANT WELL PERFORATING GUN". These applications are incorporated in their entirety herewith.

FIELD

The present embodiments generally relate to a method for making a rust resistant well perforating gun with gripping surfaces.

BACKGROUND

A need exists for a method form making a rust resistant, high quality well perforating gun having a gun carrier, charge loading tube, and end caps having a coating that protects against rust, oil, grease, particulates, and the like.

A further need exists for a method for making a rust resistant well perforating gun that has predetermined surface irregularities or recesses that allow high energy explosion pluses to exit the gun carrier while preventing the gun carrier from fracturing.

A further need exists for a method for making a clean, rust resistant well perforating gun that can reduce the amount of field time spent handling dirty charge loading tubes and rusty seal bores.

A further need exists for a method of making a rust resistant well perforating gun having gripping surfaces on an outer surface thereof, allowing users to quickly and safely assemble the rust resistant well perforating gun while reducing wear on tooling used to assemble the rust resistant well perforating gun.

The present embodiments meet these needs.

BRIEF DESCRIPTION OF THE DRAWINGS

The detailed description will be better understood in conjunction with the accompanying drawings as follows:

FIGS. 2A-2C depict detailed views of a charge loading tube according to one or more embodiments.

FIGS. 3A-3B depict detailed views of a gun carrier according to one or more embodiments.

FIGS. 4A-4B depict the charge loading tube engaged within the gun carrier according to one or more embodiments.

Figure 1:
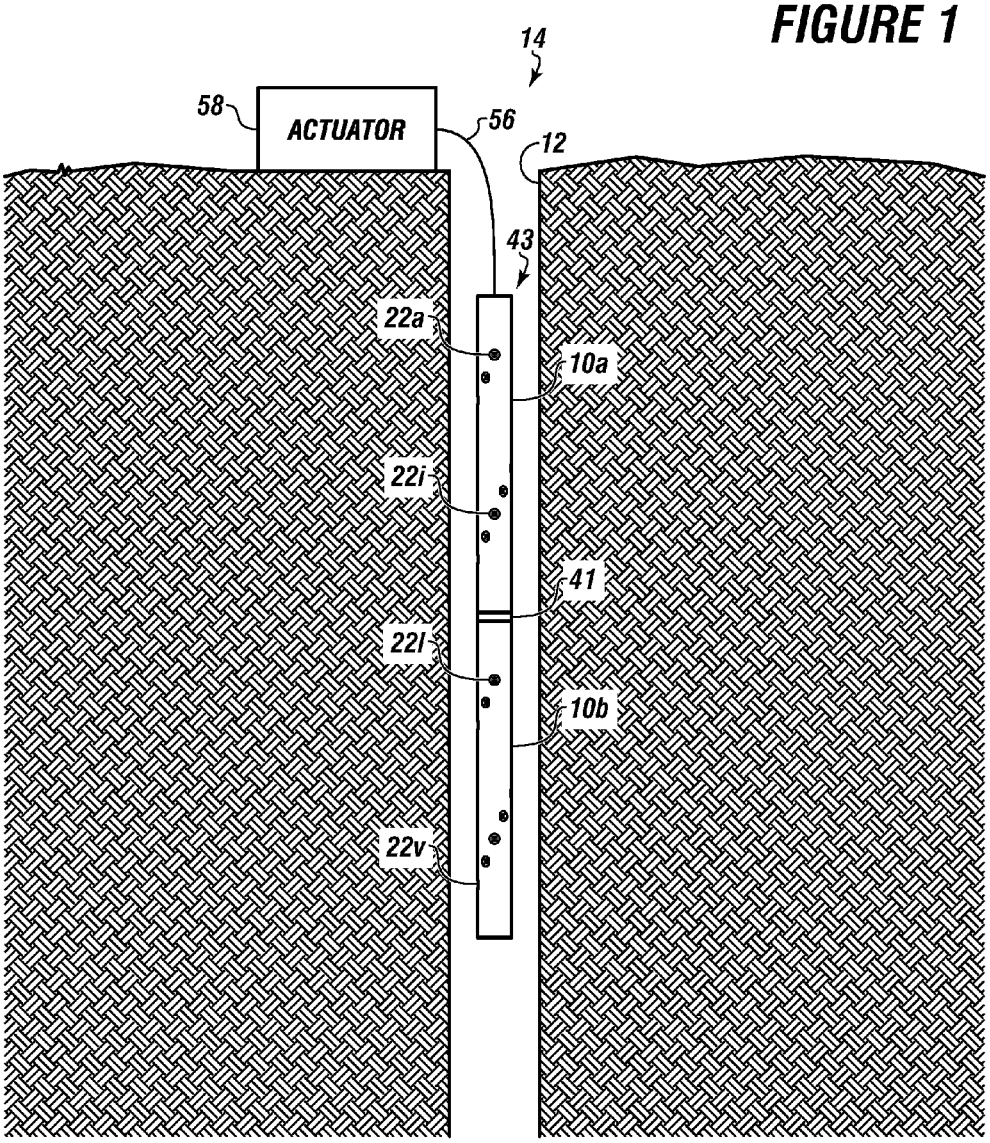
FIG. 1 depicts two rust resistant well perforating guns connected together in a wellbore of a well according to one or more embodiments.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments relate to a method for making a rust resistant well perforating gun having one or more coatings thereon to provide a rust-resistant, weather-resistant, clean, and easy to handle well perforating gun. For example, one or more embodiments of the well perforating gun can be stored in any weather without rusting for an extended time period.

The method can include using the rust resistant well perforating gun to fractionate a formation adjacent a well.

The method can include making the rust resistant well perforating gun in different sizes and different configurations for customized well use. For example, the rust resistant well perforating gun can be from about five feet long to about twenty feet long.

In operation, the rust resistant well perforating gun can be used to provide high energy pulses from an explosion without requiring the use of expensive materials with high ultimate tensile strengths.

For example, the method can include using a rust resistant well perforating gun with a gun carrier, and forming recesses or scallops in the gun carrier. The gun carrier can be a tubular structure. For example, the recesses can be portions of the gun carrier that have been machined out. The recesses can each have a diameter ranging from about 0.75 inches to about 1.5 inches.

The method can include using the recesses to provide a reduction of space between the outer surface of the gun carrier and a charge loading tube outer surface; thereby providing a space to allow a perforation burr formed during an explosion to not exceed an outside diameter of the gun carrier.

The method can include forming gripping surfaces on the outer surface of the gun carrier of the rust resistant well perforating gun. In operation, the gripping surfaces can be engaged by users to quickly and safely assemble the rust resistant well perforating gun.

For example, when engaging the gun carrier with a connecting sub, the gripping surfaces can provide an area for gripping the gun carrier with wrenches or other tooling that reduces the occurrence of slippage of the wrenches or other tooling, reduces wear on the wrenches or other tooling used to assemble the rust resistant well perforating gun, and reduces the occurrence of injuries associated with slipping wrenches and other tooling.

One or more embodiments of the method include using a rust resistant well perforating gun having a gun carrier without recesses.

The method can include coating the gun carrier with a first coating. The first coating can be disposed over the seal bores and over other portions of the gun carrier. The first coating can provide rust resistance to the gun carrier.

The first coating can be a metal coating, a metal phosphate coating, a black oxide coating, a powder coating, or a paint coating.

In one or more embodiments, a lubricant, sealer, oil, or combinations thereof can be disposed over the first coating.

The seal bores can have inner diameters ranging from about 0.05 inches to about 0.5 inches greater than the gun wall annulus.

The method can include depositing the first coating on the gun carrier by electroplating, electrophoresis, sputtering, plating, or in another way.

The rust resistant well perforating gun can include a charge loading tube, and the method can include slidably engaging the charge loading tube within the gun carrier.

The method can include forming one or more charge holes and rear charge holes in the charge loading tube for receiving and retaining charges. For example, the charge loading tube can retain from about four charges to about eighteen charges per foot of the charge loading tube.

The charge holes and rear charge holes can be concentrically aligned with the recesses when the charge loading tube is engaged within the gun carrier.

The method can include arranging and orienting the charge holes along the charge loading tube, such that the direction and number of charges can be varied to control the effect the charges The charge holes can be arranged in a helical orientation, straight line, or another orientation on the charge loading tube. The arrangement of the charge holes can be varied depending upon the application and engineering requirements. For example, differing well conductions, casings, and strata can create a need for varying configurations of the charge holes. The charge holes can each have a diameter ranging from about 0.5 inches to about 3 inches.

The method can include disposing a second coating over portions or all of the charge loading tube. The second coating can provide rust resistance to the charge loading tube.

The second coating can be a metal coating, a metal phosphate coating, a black oxide coating, a powder coating, or a paint coating.

The method can include engaging end caps on each end of the charge loading tube, and applying a third coating over portions or all of the end caps. The third coating can provide rust resistance to the end. The third coating can be a metal coating, a metal phosphate coating, a black oxide coating, a powder coating, or a paint coating.

The first coating, second coating, and third coating can each be configured to prevent rust.

The method can include forming a gap between a charge loading tube outer surface and a gun carrier annulus. The gap can be from about ⅛ of an inch to about ½ of an inch.

In one or more embodiments, the rust resistant well perforating gun can be made of high quality carbon steel or carbon alloy steel and can provide impact strength.

The gun carrier can be made to withstand high shocks delivered over short time periods created by the simultaneous detonation of multiple explosive charges.

To use the rust resistant well perforating gun, the rust resistant well perforating gun can be assembled.

For example, one or more charges can be inserted into the charge holes and rear charge holes of the charge loading tube.

Each charge can be oriented such that a tip of the charge extends through a rear charge hole and the opposite end of the charge is engaged with a charge hole.

A detonation cord can be wound around the charge loading tube, and can be engaged with each charge within the charge loading tube.

The charge loading tube can be loaded into the gun carrier to form the rust resistant well perforating gun. The charges can be aligned with the recesses in the gun carrier.

The rust resistant well perforating gun can be lowered into a well bore of a well adjacent a formation from which a material is to be extracted, such as oil, natural gas, water, or helium. The rust resistant well perforating gun can be suspended within the well bore by a coil tube or wire line device.

The detonation cord can be connected to an actuator on the surface. The actuator can be activated to send a signal to the charges. Upon receipt of the signal, the charges can explode within the gun carrier. Upon explosion, a high pressure can fill the gap between the charge loading tube and the gun carrier to produce high pressure jets that can break through the recesses.

The high pressure jets can fractionate the formation in adjacent strata, causing the material to enter the well bore.

In one or more embodiments, multiple rust resistant well perforating guns can be strung together using the detonation cord for increased explosive capacity.

After detonation, the rust resistant well perforating gun can be removed from the well.

In one or more embodiments, the first coating on the gun carrier, second coating on the charge loading tube, and third coating on the end caps can be a zinc phosphate coating, and can be applied by: cleaning a surface of the gun carrier, charge loading tube, and end caps; rinsing the gun carrier, charge loading tube, and end caps; activating the gun carrier, charge loading tube, and end caps; phosphating the gun carrier, charge loading tube, and end caps; rinsing the gun carrier, charge loading tube, and end caps; performing a neutralizing rinse on the gun carrier, charge loading tube, and end caps; drying the gun carrier, charge loading tube, and end caps; and applying any supplemental coatings on the gun carrier, charge loading tube, and end caps. The supplemental coatings can include lubricants, sealer, oil, or the like.

In one or more embodiments, the first coating on the gun carrier, second coating on the charge loading tube, and third coating on the end caps can be a black oxide coating, and can be applied by: cleaning the surface of the gun carrier, charge loading tube, and end caps; rinsing the gun carrier, charge loading tube, and end caps; acid pickling or alkaline descaling the gun carrier, charge loading tube, and end caps to remove rust; dipping the gun carrier, charge loading tube, and end caps in black oxide; rinsing the gun carrier, charge loading tube, and end caps; and applying any supplemental coating to the gun carrier, charge loading tube, and end caps. As such, the surface of the gun carrier, charge loading tube, and end caps can be converted into magnetite.

In one or more embodiments, zinc plating the gun carrier, charge loading tube, and end caps can be performed by: cleaning the surface of gun carrier, charge loading tube, and end caps, dipping the gun carrier, charge loading tube, and end caps in a vat of molten zinc, and drying the gun carrier, charge loading tube, and end caps.

A yellow chromate coating can be applied to the gun carrier, charge loading tube, and end caps after zinc plating is performed. Providing a yellow chromate coating can include: immersing a zinc plated gun carrier, charge loading tube, and end caps in a chromate solution and drying the gun carrier, charge loading tube, and end caps.

For example, a batch of a colored chromate solution for coating the gun carrier, charge loading tube, and end caps can be made up, and can be maintained at a temperature ranging from about 90 degrees Fahrenheit to about 150 degrees Fahrenheit and a pH ranging from about 1.65 to about 2.0. The gun carrier, charge loading tube, and end caps can be rinsed with cold water, rinsed with a 0.5%/volume-1.0 volume solution of sulfuric acid, to neutralize residual zinc plating solution, rinsed a second time with cold water, immersed in the batch of colored chromate solution for a length of time sufficient to produce a particular finish, hot air dried at about 150 degrees Fahrenheit or spun dry, and baked at a temperature ranging from about 350 degrees Fahrenheit to about 400 degrees Fahrenheit for a time ranging from about 4 hours to about 24 hours to produce a high corrosion resistance.

Turning now to the Figures, FIG. 1 depicts multiple rust resistant well perforating guns 10*a* and 10*b* connected together by a connector structure 41 to form a multi-tube construction 43. For example, the connector structure 41 can have connector structure threaded portions to engage with the threaded portions of adjacent gun carriers; thereby connecting the adjacent rust resistant well perforating guns 10*a* and 10*b*.

The rust resistant well perforating guns 10*a* and 10*b* can be inserted into a well bore 12 of a well 14, such as an oil, natural gas, or water well.

A detonation cord 56 can be engaged with each charge disposed within the rust resistant well perforating guns 10*a* and 10*b*. The detonation cord 56 can be connected to an actuator 58. The detonation cord 56 and actuator 58 can be engaged with the top of the rust resistant well perforating guns 10*a* and 10*b* or the bottom of the rust resistant well perforating guns 10*a* and 10*b*.

In operation, the actuator 58 can be configured to actuate each charge disposed within the rust resistant well perforating guns 10*a* and 10*b* by sending a signal through the detonation cord 56.

Upon actuation of the charges disposed within the rust resistant well perforating guns 10*a* and 10*b*, the charges can explode through the recesses 22*a*, 22*i*, 22*l*, and 22*v* formed in the gun carriers of the rust resistant well perforating guns 10*a* and 10*b* and into the well bore 12 to fracture portions of the well bore 12.

FIGS. 2A-2C depict detailed views of the charge loading tube 32, which can be configured to slidably engage within the gun wall annulus of the gun carrier.

The charge loading tube 32 can have a charge loading tube inner surface 36 and a charge loading tube outer surface 38.

A plurality of charge holes, such as charge holes 40*a* and 40*j*, can be disposed through the charge loading tube 32. Each charge hole 40*a* and 40*j* can be configured to be concentrically aligned with one of the recesses of the gun carrier when the charge loading tube 32 is slidably engaged within the gun wall annulus. The charge holes 40*a* and 40*j* can be circular, elliptical, or another shape.

A plurality of rear charge holes, such as rear charge hole 44*c*, 44*f*, and 44*j*, can be disposed through the charge loading tube 32. Each rear charge hole can be concentrically aligned one of the charge holes. For example, the rear charge hole 44*j* can be concentrically aligned with the charge hole 40*j*. The rear charge holes can be circular, elliptical, or another shape.

In one or more embodiments, the charge loading tube outer surface 38 can have from about four to about eighteen charge holes and rear charge holes per foot of the charge loading tube outer surface 38.

A plurality of charge retaining cutouts, such as charge retaining cutouts 42*a* and 42*b*, can be disposed through the charge loading tube 32. Each charge retaining cutout 42*a* and 42*b* can be configured to receive and retain a charge. For example, a portion of a charge can be disposed through one of the charge retaining cutouts 42*a* and 42*b* and bent to hold the charge within that charge retaining cutouts 42*a* and 42*b*.

One or more embodiments of the charge loading tube 32 can have a second coating to prevent rust. The second coating can include a second zinc metal coating 53 disposed on the charge loading tube 32 and a second chromate coating 52 disposed over the second zinc metal coating 53. For example, the second chromate coating 52 can be a clear chromate coating, a yellow chromate coating, or another colored chromate coating.

The second coating can be disposed over the charge loading tube outer surface 38. In one or more embodiments, the second coating can have a melting point of over 700 degrees Fahrenheit, a Young's modulus of about 100 gigapascals, and a Mohs hardness of at least 2.5. The second coating can have a thickness ranging from about 0.00015 inches to about 0.001 inches.

In one or more embodiments, the second coating can be a metal coating, a metal phosphate coating, a black oxide coating, a powder coating, or a paint coating. The metal coating can be zinc, platinum, palladium, nickel, silver, gold, aluminum, or tin. The metal phosphate coating can be zinc phosphate, manganese phosphate, or iron phosphate.

The end caps 46*a* and 46*b* can be secured to the charge loading tube 32 with a threaded connection, fasteners, a weld, or a forced fit. For example, the charge loading tube 32 can have a first fastener 51*a* for attaching the first end cap 46*a* to the charge loading tube 32, and a second fastener 51*b* for attaching the second end cap 46*b* to the charge loading tube 32.

The end caps 46*a* and 46*b* can be made of aluminum, high density plastic, carbon steel, or combinations thereof.

In one or more embodiments, the end caps 46*a* and 46*b* can have a third coating disposed over the end caps 46*a* and 46*b* to prevent rust. For example, the third coating can include a third zinc metal coating 63 disposed on the end cap 46*b* and a third chromate coating 61 disposed over the third zinc metal coating 63. For example, the third chromate coating 61 can be a clear chromate coating, a yellow chromate coating, or another colored chromate coating.

In one or more embodiments, a lubricant, sealer, oil, or combinations thereof 31*a* and 31*b* can be disposed over the second coating and the third coating.

In one or more embodiments, the charge loading tube 32 can have one or more offset surfaces 35*a* and 35*b*, such as pins. The offset surfaces 35*a* and 35*b* can be configured to engage with a keyway of the gun carrier to align the charge loading tube 32 with the gun carrier.

One or more embodiments of the charge loading tube 32 can have a message area 60 disposed on or through the charge loading tube outer surface 38. The message area 60 can be printed onto the charge loading tube 32, engraved into the charge loading tube 32, cut into the charge loading tube 32, or otherwise disposed thereon.

The message area 60 can provide identification of a source of the charge loading tube 32. For example, if the charge loading tube is stolen or otherwise lost, the message area 60 can identify the proper owner of the charge loading tube 32. Also, if the charge loading tube 32 is exploded unintentionally, the message area 60 can identify the source of the charge loading tube 32 for tracking and investigative purposes.

A charge 54 can be engaged at one end through each charge hole of the charge loading tube 32, such as the charge hole 40*j*. The charge 54 can be engaged at the opposite end through each rear charge hole of the charge loading tube 32, such as the rear charge hole 44*j*.

In operation, the charge 54 can be longitudinally inserted into the charge loading tube 32 through the charge hole 40*j* and through the rear charge hole 44*j* concentrically aligned with the charge hole 40*j*.

The charge 54 can be engaged with the detonation cord 56 for receiving a detonation signal from the actuator.

FIGS. 3A-3B depict detailed views of a gun carrier 16.

The gun carrier 16 can be made of carbon steel or carbon alloy steel. The gun carrier 16 can have a gun wall annulus 18 and an outer surface 20.

A plurality of recesses 22*a* and 22*j* can be formed into the outer surface 20. Each recess 22*a* and 22*j* can be formed to a predetermined depth in the outer surface 20, such as a depth of about 0.25 inches without fully penetrating through to the gun carrier 16. In one or more embodiments, the outer surface 20 can have from about four to about eighteen recesses per foot of the outer surface 20.

The plurality of recesses can be disposed about the outer surface 20 in a spiraling or helical pattern. Each of the recesses can be elliptical, circular, rounded, or another shape.

A first threaded section 24*a* can be formed in the gun wall annulus 18 proximate a first end of the gun carrier 16. A second threaded section 24*b* can be formed in the gun wall annulus 18 proximate a second end of the gun carrier 16. The threaded sections 24*a* and 24*b* can have thread densities ranging from about four threads per inch to about eight threads per inch.

A first seal bore 26*a* can be formed in the gun wall annulus 18 between the first threaded section 24*a* and the first end of the gun carrier 16. A second seal bore 26*b* can be formed in the gun wall annulus 18 between the second threaded section 24*b* and the second end of the gun carrier 16.

A first coating can be disposed over the gun carrier 16, such as over the first seal bore 26*a* and the second seal bore 26*b*, or over the entirety of the gun carrier 16.

The first coating can include a first zinc metal coating 28 disposed on the gun carrier 16 and a first chromate coating 29 disposed over the first zinc metal coating 28. The first coating can have a thickness ranging from about 0.00015 inches to about 0.001 inches.

The first chromate coating 29 can be a clear chromate coating, a yellow chromate coating, or another colored chromate coating.

In one or more embodiments, the first coating can be a metal coating, a metal phosphate coating, a black oxide coating, a powder coating, or a paint. The metal coating can be zinc, platinum, palladium, nickel, silver, gold, aluminum, or tin. The metal phosphate coating can be zinc phosphate, manganese phosphate, or iron phosphate.

The first coating can also be disposed over the outer surface 20 or an entirety of the gun carrier 16. The first coating can prevent rusting of the gun carrier 16.

In one or more embodiments, a lubricant, sealer, oil, or combinations thereof 31*c* can be disposed over the first coating.

In one or more embodiments, one of the threaded sections 24*a* and 24*b*, such as the second threaded section 24*b*, can have a keyway 34. The keyway 34 can engage with one or more offset surfaces of the charge loading tube to align the charge loading tube with the gun carrier 16.

In one or more embodiments, a first gripping surface 21*a* can be formed on the outer surface 20 of the gun carrier 16 proximate the first end of the gun carrier 16, and a second gripping surface 21*b* can be formed on the outer surface 20 of the gun carrier 16 proximate the second end of the gun carrier 16.

The first gripping surface 21*a* and second gripping surface 21*b* can be knurling, scoring, turned bands, or the like.

In operation, the first gripping surface 21*a* and second gripping surface 21*b* can be engaged by users to quickly and safely assemble the rust resistant well perforating gun, such as with wrenches or other tooling. The first gripping surface 21*a* and second gripping surface 21*b* can reduce the occurrence of slippage of the wrenches or other tooling, reduce wear on the wrenches or other tooling, and reduce the occurrence user injuries associated with slipping wrenches and other tooling.

FIGS. 4A-4B depict a rust resistant well perforating gun 10 including a charge loading tube 32 engaged within a gun carrier 16. For example, the charge loading tube 32 can be slidably engaged within the gun carrier 16.

The charge loading tube 32 can have a first end cap 46*a* disposed on a first end of the charge loading tube 32. A second end cap 46*b* can be disposed on a second end of the charge loading tube 32.

Each end cap 46*a* and 46*b* can have a diameter larger than the charge loading tube outer surface; thereby forming a gap 50 between the charge loading tube 32 and the gun carrier 16.

With the charge loading tube 32 engaged within the gun carrier 16, the plurality of recesses 22*a*, 22*b*, 22*g*, 22*h*, and 22*i* can be aligned with the plurality of charge holes 40*a*, 40*b*, 40*g*, 40*h*, and 40*i*. For example, the charge hole 40*a* can be aligned with the recess 22*a*. A plurality of rear charge holes 44*c*, 44*d*, 44*e*, 44*f*, and 44*j* can be disposed along the charge loading tube 32 opposite the plurality of charge holes 40*a*, 40*b*, 40*g*, 40*h*, and 40*i*.

Figure 5A:
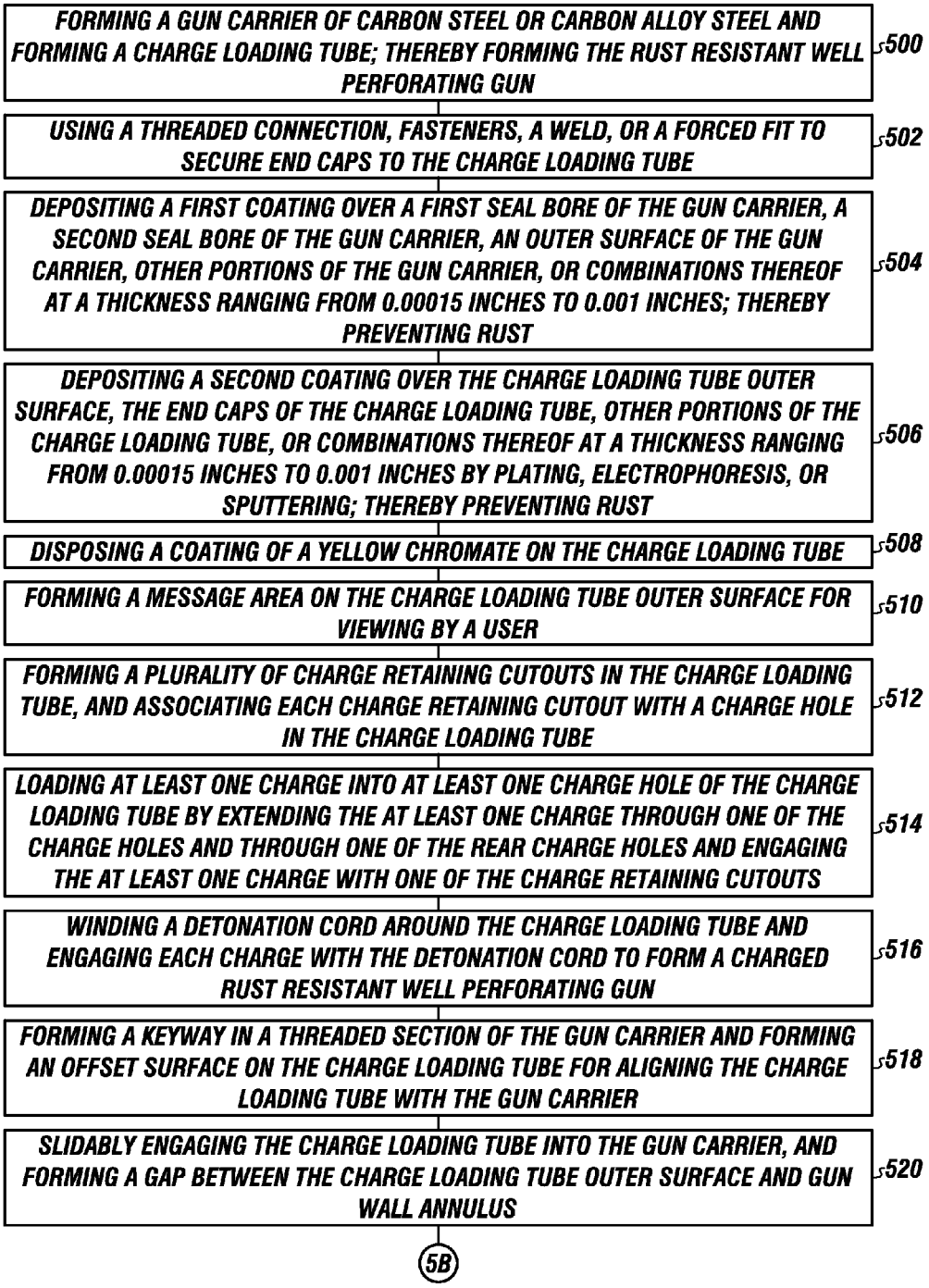
FIGS. 5A-5B depict a method for perforating a well according to one or more embodiments.
Figure 5B:
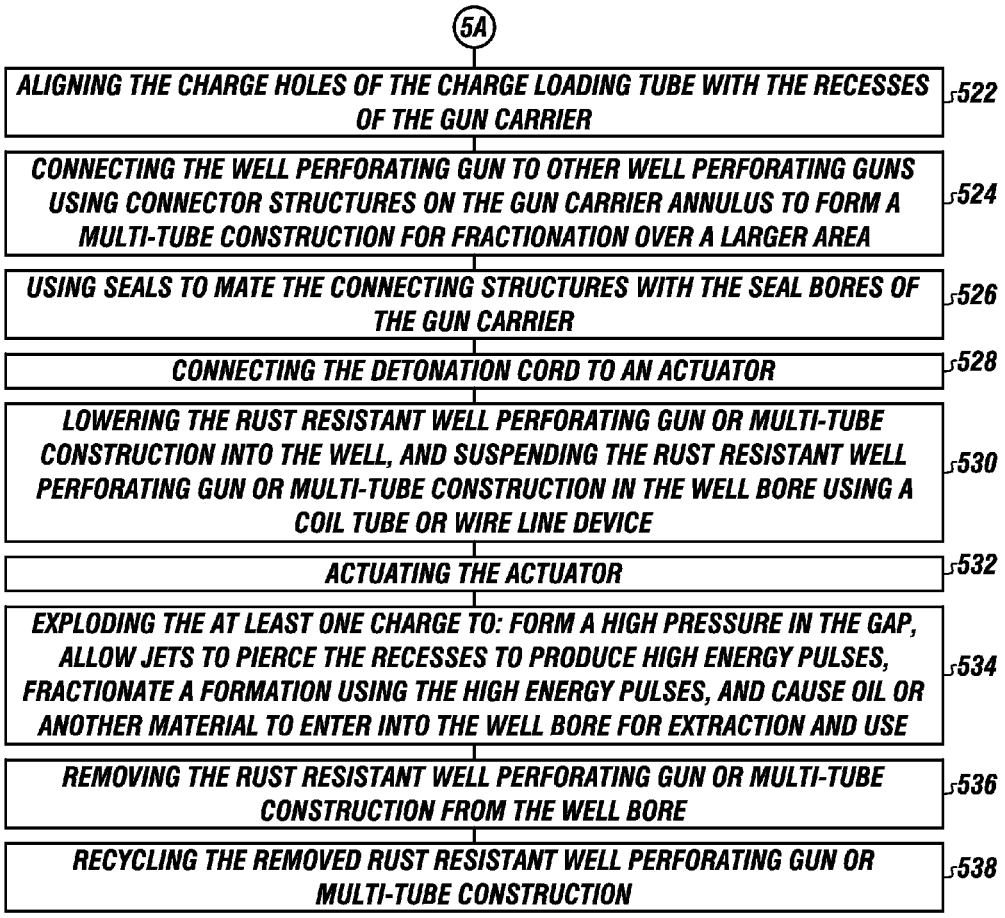

FIGS. 5A-5B depict an embodiment of a method for fractionating a well using a rust resistant well perforating gun.

The method can include forming a gun carrier of carbon steel or carbon alloy steel and forming a charge loading tube; thereby forming the rust resistant well perforating gun, as illustrated by box 500.

The method can include using a threaded connection, fasteners, a weld, or a forced fit to secure end caps to the charge loading tube, as illustrated by box 502.

The method can include depositing a first coating over a first seal bore of the gun carrier, a second seal bore of the gun carrier, an outer surface of the gun carrier, other portions of the gun carrier, or combinations thereof at a thickness ranging from 0.00015 inches to 0.001 inches; thereby preventing rust, as illustrated by box 504.

The method can include depositing a second coating over the charge loading tube outer surface, the end caps of the charge loading tube, other portions of the charge loading tube, or combinations thereof at a thickness ranging from 0.00015 inches to 0.001 inches by plating, electrophoresis, or sputtering; thereby preventing rust, as illustrated by box 506.

The method can include disposing a coating of a yellow chromate on the charge loading tube, as illustrated by box 508.

The method can include forming a message area on the charge loading tube outer surface for viewing by a user, as illustrated by box 510.

The method can include forming a plurality of charge retaining cutouts in the charge loading tube, and associating each charge retaining cutout with a charge hole in the charge loading tube, as illustrated by box 512.

The method can include loading at least one charge into at least one charge hole of the charge loading tube by extending the at least one charge through one of the charge holes and through one of the rear charge holes and engaging the at least one charge with one of the charge retaining cutouts, as illustrated by box 514.

The method can include winding a detonation cord around the charge loading tube and engaging each charge with the detonation cord to form a charged rust resistant well perforating gun, as illustrated by box 516.

The method can include forming a keyway in a threaded section of the gun carrier and forming an offset surface on the charge loading tube for aligning the charge loading tube with the gun carrier, as illustrated by box 518.

The method can include slidably engaging the charge loading tube into the gun carrier, and forming a gap between the charge loading tube outer surface and gun wall annulus, as illustrated by box 520.

The method can include aligning the charge holes of the charge loading tube with the recesses of the gun carrier, as illustrated by box 522.

The method can include connecting the well perforating gun to other well perforating guns using connector structures on the gun carrier annulus to form a multi-tube construction for fractionation over a larger area, as illustrated by box 524.

The method can include using seals to mate the connecting structures with the seal bores of the gun carrier, as illustrated by box 526.

The seals can help provide rust-resistance to the rust resistant well perforating gun. The seals can be O-rings.

The method can include connecting the detonation cord to an actuator, as illustrated by box 528.

The method can include lowering the rust resistant well perforating gun or multi-tube construction into the well, and suspending the rust resistant well perforating gun or multi-tube construction in the well bore using a coil tube or wire line device, as illustrated by box 530.

The method can include actuating the actuator, as illustrated by box 532.

The method can include exploding the at least one charge to: form a high pressure in the gap, allow jets to pierce the recesses to produce high energy pulses, fractionate a formation using the high energy pulses, and cause oil or another material to enter into the well bore for extraction and use, as illustrated by box 534.

The method can include removing the rust resistant well perforating gun or multi-tube construction from the well bore, as illustrated by box 536.

The method can include recycling the removed rust resistant well perforating gun or multi-tube construction, as illustrated by box 538.

Figure 6A:
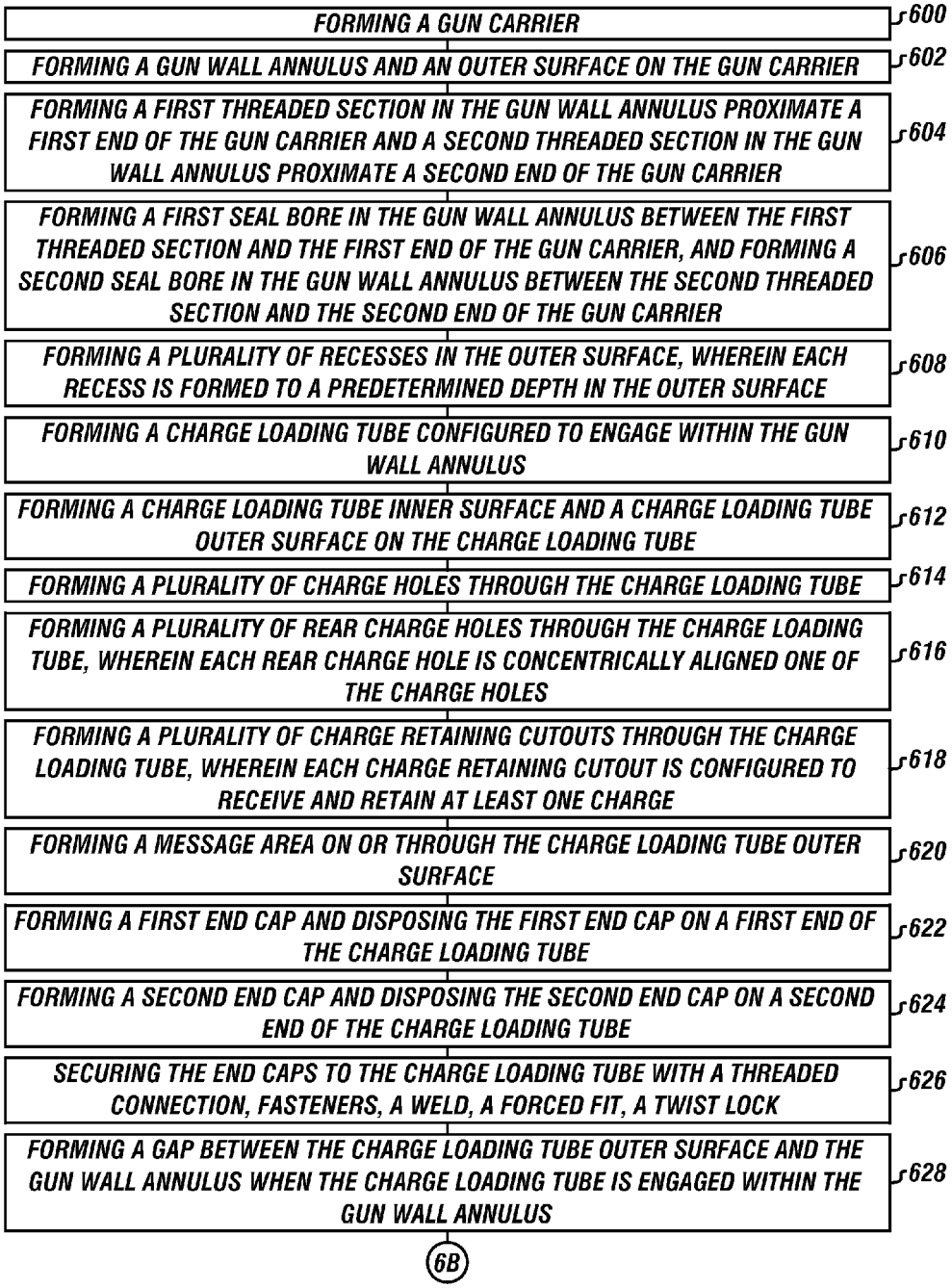
FIGS. 6A-6B depict a method for making a rust resistant well perforating gun according to one or more embodiments.
Figure 6B:
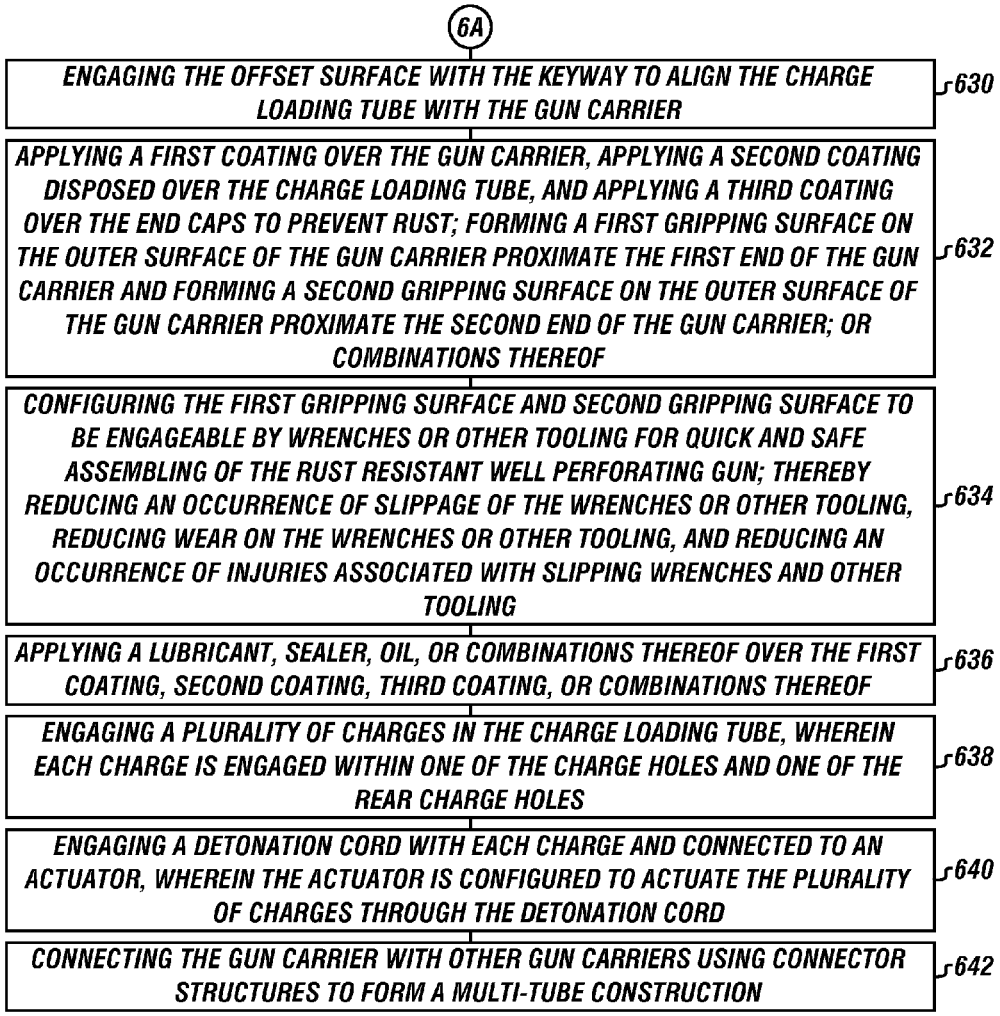

FIGS. 6A-6B depict a method for making a well perforating gun to have rust resistance and gripping surfaces.

The method can include forming a gun carrier, as illustrated by box 600.

For example, the gun carrier can be formed of carbon steel or carbon alloy steel.

The method can include forming a gun wall annulus and an outer surface on the gun carrier, as illustrated by box 602.

The method can include forming a first threaded section in the gun wall annulus proximate a first end of the gun carrier and a second threaded section in the gun wall annulus proximate a second end of the gun carrier, as illustrated by box 604.

The method can include forming a first seal bore in the gun wall annulus between the first threaded section and the first end of the gun carrier, and forming a second seal bore in the gun wall annulus between the second threaded section and the second end of the gun carrier, as illustrated by box 606.

The method can include forming a plurality of recesses in the outer surface, wherein each recess is formed to a predetermined depth in the outer surface, as illustrated by box 608.

The method can include forming a charge loading tube configured to engage within the gun wall annulus, as illustrated by box 610.

The method can include forming a charge loading tube inner surface and a charge loading tube outer surface on the charge loading tube, as illustrated by box 612.

The method can include forming a plurality of charge holes through the charge loading tube, as illustrated by box 614.

The method can include forming a plurality of rear charge holes through the charge loading tube, wherein each rear charge hole is concentrically aligned one of the charge holes, as illustrated by box 616.

The method can include forming a plurality of charge retaining cutouts through the charge loading tube, wherein each charge retaining cutout is configured to receive and retain at least one charge, as illustrated by box 618.

The method can include forming a message area on or through the charge loading tube outer surface, as illustrated by box 620.

The method can include forming a first end cap and disposing the first end cap on a first end of the charge loading tube, as illustrated by box 622.

The method can include forming a second end cap and disposing the second end cap on a second end of the charge loading tube, as illustrated by box 624.

For example, the end caps can be formed of aluminum, high density plastic, carbon steel, zinc casting, or combinations thereof.

The method can include securing the end caps to the charge loading tube with a threaded connection, fasteners, a weld, a forced fit, a twist lock, as illustrated by box 626.

The method can include forming a gap between the charge loading tube outer surface and the gun wall annulus when the charge loading tube is engaged within the gun wall annulus, as illustrated by box 628.

For example, the end caps can be formed to have diameters that are larger than the charge loading tube outer surface; thereby forming the gap.

In one or more embodiments, one of the threaded sections of the gun carrier can have a keyway and the charge loading tube can have an offset surface.

The method can include engaging the offset surface with the keyway to align the charge loading tube with the gun carrier, as illustrated by box 630.

The method can include: applying a first coating over the gun carrier, applying a second coating disposed over the charge loading tube, and applying a third coating over the end caps to prevent rust; forming a first gripping surface on the outer surface of the gun carrier proximate the first end of the gun carrier and forming a second gripping surface on the outer surface of the gun carrier proximate the second end of the gun carrier; or combinations thereof, as illustrated by box 632.

For example, the first coating can be applied by first applying a first zinc metal coating on the gun carrier, and then applying a first chromate coating over the first zinc metal coating. The second coating can be applied by first applying a second zinc metal coating on the charge loading tube, and then applying a second chromate coating over the second zinc metal coating. The third coating can be applied by first applying a third zinc metal coating on the end caps, and then applying a third chromate coating over the third zinc metal coating.

In one or more embodiments, the first coating, second coating, and third coating can be applied by plating, electrophoresis, or sputtering.

In one or more embodiments, the first chromate coating, second chromate coating, and third chromate coating can each be a clear chromate coating, yellow chromate coating, or another colored chromate coating.

In one or more embodiments, the first coating, second coating, and third coating can each be: a metal coating, a metal phosphate coating, a black oxide coating, a powder coating, a paint coating, or combinations thereof.

The metal coating can be zinc, platinum, palladium, nickel, silver, gold, aluminum, or tin, and the metal phosphate coating can be zinc phosphate, manganese phosphate, or iron phosphate. The metal coating can be applied to a thickness ranging from 0.00015 inches to 0.001 inches, the metal phosphate coating can be applied to a thickness ranging from 0.00015 inches to 0.001 inches, or combinations thereof.

The first gripping surface and second gripping surface can be formed as: knurling, scoring, turned bands, or the like.

The method can include configuring the first gripping surface and second gripping surface to be engageable by wrenches or other tooling for quick and safe assembling of the rust resistant well perforating gun; thereby reducing an occurrence of slippage of the wrenches or other tooling, reducing wear on the wrenches or other tooling, and reducing an occurrence of injuries associated with slipping wrenches and other tooling, as illustrated by box 634.

The method can include applying a lubricant, sealer, oil, or combinations thereof over the first coating, second coating, third coating, or combinations thereof, as illustrated by box 636.

The method can include engaging a plurality of charges in the charge loading tube, wherein each charge is engaged within one of the charge holes and one of the rear charge holes, as illustrated by box 638.

The method can include engaging a detonation cord with each charge and connected to an actuator, wherein the actuator is configured to actuate the plurality of charges through the detonation cord, as illustrated by box 640.

The method can include connecting the gun carrier with other gun carriers using connector structures to form a multi-tube construction, as illustrated by box 642.

While these embodiments have been described with emphasis on the embodiments, it should be understood that within the scope of the appended claims, the embodiments might be practiced other than as specifically described herein.

What is claimed is:

1. A method for making a well perforating gun to have rust resistance and gripping surfaces, the method comprising:

a. forming a gun carrier comprising:
   (i) a gun wall annulus and an outer surface;
   (ii) a first threaded section formed in the gun wall annulus proximate a first end of the gun carrier, and a second threaded section formed in the gun wall annulus proximate a second end of the gun carrier; and
   (iii) a first seal bore formed in the gun wall annulus between the first threaded section and the first end of the gun carrier, and a second seal bore formed in the gun wall annulus between the second threaded section and the second end of the gun carrier;

b. forming a charge loading tube configured to engage within the gun wall annulus, wherein the charge loading tube comprises:
   (i) a charge loading tube inner surface;
   (ii) a charge loading tube outer surface;
   (iii) a plurality of charge holes disposed through the charge loading tube; and
   (iv) a plurality of rear charge holes disposed through the charge loading tube, wherein each rear charge hole is concentrically aligned one of the charge holes;

c. forming a first end cap disposed on a first end of the charge loading tube, and forming a second end cap disposed on a second end of the charge loading tube, wherein the end caps have a diameter larger than the charge loading tube outer surface forming a gap between the charge loading tube outer surface and the gun wall annulus when the charge loading tube is engaged within the gun wall annulus; and d. applying a first coating over the gun carrier, applying a second coating disposed over the charge loading tube, and applying a third coating over the end caps, wherein the first coating, the second coating, and the third coating are configured to prevent rust or forming a first gripping surface on the outer surface of the gun carrier proximate the first end of the gun carrier and forming a second gripping surface on the outer surface of the gun carrier proximate the second end of the gun carrier.

2. The method of claim 1, wherein the first gripping surface and the second gripping surface are formed as: knurling, scoring, or turned bands.

3. The method of claim 1, wherein the first gripping surface and the second gripping surface are configured to be engaged by wrenches or other tooling for quickly and safely assembling the rust resistant well perforating gun; thereby reducing an occurrence of slippage of the wrenches or other tooling, reducing wear on the wrenches or other tooling, and reducing an occurrence of injuries associated with slipping wrenches and other tooling.

4. The method of claim 1, further comprising:

a. engaging a plurality of charges in the charge loading tube, wherein each charge is engaged within one of the charge holes and one of the rear charge holes; and b. engaging a detonation cord with each charge and connected to an actuator, wherein the actuator is configured to actuate the plurality of charges through the detonation cord.

5. The method of claim 1, wherein:

a. the first coating comprises a first zinc metal coating disposed on the gun carrier and a first chromate coating disposed over the first zinc metal coating;

b. the second coating comprises a second zinc metal coating disposed on the charge loading tube and a second chromate coating disposed over the second zinc metal coating; and c. the third coating comprises a third zinc metal coating disposed on the charge loading tube and a third chromate coating disposed over the third zinc metal coating.

6. The method of claim 5, wherein the first chromate coating, second chromate coating, and third chromate coating are each a clear chromate coating, a yellow chromate coating, or another colored chromate coating.

7. The method of claim 1, wherein the first coating, the second coating, and the third coating are each selected from the group consisting of: a metal coating, a metal phosphate coating, a black oxide coating, a powder coating, and a paint coating.

8. The method of claim 7, wherein:

a. the metal coating is zinc, platinum, palladium, nickel, silver, gold, aluminum, or tin; and b. the metal phosphate coating is zinc phosphate, manganese phosphate, or iron phosphate.

9. The method of claim 7, wherein:

a. the metal phosphate coating is applied to a thickness ranging from 0.00015 inches to 0.001 inches;

b. the metal coating is applied to a thickness ranging from 0.00015 inches to 0.001 inches; or c. both the metal phosphate coating has the thickness ranging from 0.00015 inches to 0.001 inches and the metal coating has the thickness ranging from 0.00015 inches to 0.001 inches.

10. The method of claim 1, further comprising applying a lubricant, sealer, or oil thereof over the first coating, the second coating, or both the first coating and the second coating.

11. The method of claim 1, further comprising forming a plurality of recesses in the outer surface, wherein each recess is formed to a predetermined depth in the outer surface.

12. The method of claim 1, wherein the gun carrier is formed of carbon steel or carbon alloy steel.

13. The method of claim 1, further comprising:

a. forming the end caps of aluminum, high density plastic, carbon steel, or zinc casting;

b. securing the end caps to the charge loading tube with a threaded connection, fasteners, a weld, a forced fit, or a twist lock; or c. both the end caps comprise aluminum, high density plastic, carbon steel, or zinc casting and the end caps are secured to the charge loading tube with a threaded connection, fasteners, a weld, a forced fit, or a twist lock.

14. The method of claim 1, further comprising connecting the gun carrier with other gun carriers using connector structures to form a multi-tube construction.

15. The method of claim 1, wherein one of the threaded sections comprises a keyway, wherein the charge loading tube comprises an offset surface, and wherein the method further comprises engaging the offset surface with the keyway to align the charge loading tube with the gun carrier.

16. The method of claim 1, further comprising forming a plurality of charge retaining cutouts disposed through the charge loading tube, wherein each charge retaining cutout is configured to receive and retain at least one charge.

17. The method of claim 1, further comprising forming a message area on or through the charge loading tube outer surface.

18. The method of claim 1, further comprising applying the first coating, the second coating, and the third coating by plating, electrophoresis, or sputtering.

19. A method for making a well perforating gun to have rust resistance and gripping surfaces, the method comprising:

a. forming a gun carrier comprising:

(i) a gun wall annulus and an outer surface;

(ii) a first threaded section formed in the gun wall annulus proximate a first end of the gun carrier, and a second threaded section formed in the gun wall annulus proximate a second end of the gun carrier; and (iii) a first seal bore formed in the gun wall annulus between the first threaded section and the first end of the gun carrier, and a second seal bore formed in the gun wall annulus between the second threaded section and the second end of the gun carrier;

b. forming a first gripping surface on the outer surface of the gun carrier proximate the first end of the gun carrier, and a second gripping surface formed on the outer surface of the gun carrier proximate the second end of the gun carrier;

c. forming a charge loading tube configured to engage within the gun wall annulus, wherein the charge loading tube comprises:

(i) a charge loading tube inner surface;

(ii) a charge loading tube outer surface;

(iii) a plurality of charge holes disposed through the charge loading tube; and (iv) a plurality of rear charge holes disposed through the charge loading tube, wherein each rear charge hole is concentrically aligned one of the charge holes; and d. forming a first end cap disposed on a first end of the charge loading tube, and forming a second end cap disposed on a second end of the charge loading tube, wherein the end caps have a diameter larger than the charge loading tube outer surface forming a gap between the charge loading tube outer surface and the gun wall annulus when the charge loading tube is engaged within the gun wall annulus; and e. applying a coating over the gun carrier.

20. A method for making a well perforating gun to have rust resistance and gripping surfaces, the method comprising:

a. forming a gun carrier comprising:

(i) a gun wall annulus and an outer surface;

(ii) a first threaded section formed in the gun wall annulus proximate a first end of the gun carrier, and a second threaded section formed in the gun wall annulus proximate a second end of the gun carrier; and (iii) a first seal bore formed in the gun wall annulus between the first threaded section and the first end of the gun carrier, and a second seal bore formed in the gun wall annulus between the second threaded section and the second end of the gun carrier;

b. applying a first coating over the gun carrier, wherein the first coating is configured to prevent rust;

c. forming a charge loading tube configured to engage within the gun wall annulus, wherein the charge loading tube comprises:

(i) a charge loading tube inner surface;

(ii) a charge loading tube outer surface;

(iii) a plurality of charge holes disposed through the charge loading tube; and (iv) a plurality of rear charge holes disposed through the charge loading tube, wherein each rear charge hole is concentrically aligned one of the charge holes;

d. applying a second coating disposed over the charge loading tube, wherein the second coating is configured to prevent rust;

e. forming a first end cap disposed on a first end of the charge loading tube, and forming a second end cap disposed on a second end of the charge loading tube, wherein the end caps have a diameter larger than the charge loading tube outer surface forming a gap between the charge loading tube outer surface and the gun wall annulus when the charge loading tube is engaged within the gun wall annulus; and f. applying a third coating over the end caps, wherein the third coating is configured to prevent rust, and wherein the first coating comprises a first zinc metal coating disposed on the gun carrier and a first chromate coating disposed over the first zinc metal coating, the second coating comprises a second zinc metal coating disposed on the charge loading tube and a second chromate coating disposed over the second zinc metal coating, and the third coating comprises a third zinc metal coating disposed on the charge loading tube and a third chromate coating disposed over the third zinc metal coating.

* * * * *